United States Patent [19]

Tschudin-Mahrer

[11] Patent Number: 4,767,655

[45] Date of Patent: Aug. 30, 1988

[54] SEALING STRIP

[75] Inventor: Rolf Tschudin-Mahrer, Lausen, Switzerland

[73] Assignee: Irbit Research & Consulting AG, Switzerland

[21] Appl. No.: 942,000

[22] Filed: Dec. 12, 1986

[30] Foreign Application Priority Data

Dec. 14, 1985 [DE] Fed. Rep. of Germany ..... 3544277

[51] Int. Cl.[4] ..... B32B 3/00; B32B 3/26; B32B 7/04

[52] U.S. Cl. ..... 428/57; 206/83.5; 428/58; 428/71; 428/316.6; 428/317.1; 428/318.6; 428/318.8

[58] Field of Search ..... 206/83.5, 324, 411, 206/451; 428/906, 57, 58, 71, 316.6, 317.1, 317.3, 317.7, 318.6, 318.8

[56] References Cited

U.S. PATENT DOCUMENTS 4,401,716 8/1983 Tschudin-Mahrer ..... 428/317.3
4,564,550 1/1986 Tschudin-Mahrer ..... 428/317.1
4,621,731 11/1986 Tschudin-Mahrer ..... 206/83.5
4,666,768 5/1987 Tschudin-Mahrer ..... 428/318.6

FOREIGN PATENT DOCUMENTS 0059062 1/1982 European Pat. Off. .
937354 1/1956 Fed. Rep. of Germany ... 428/316.6
1569052 12/1964 Fed. Rep. of Germany .
2309768 11/1976 France .

OTHER PUBLICATIONS

Examiner's Search Report of European application EP 86 11 6816, 6-18-87.

*Primary Examiner*—William J. Van Balen
*Attorney, Agent, or Firm*—Wood, Herron & Evans

[57] ABSTRACT

The invention concerns a joint sealing strip (D) consisting of open-cell precompressed foam material with which strip there is coordinated a foil (4) joining in the restoring of the foam material, and the invention suggests, specifically for optimizing the laying of the strip in a sealing manner, that the foil (4) be fashioned as an intermediate layer which is areally bonded to the foam material layers (1), between these layers.

8 Claims, 2 Drawing Sheets

SEALING STRIP

BACKGROUND OF THE PRESENT INVENTION

The invention concerns a sealing strip with delayed restoring which consists of open-cell precompressed foam material and serves specifically the sealing of joints, with which strip an expandable foil is coordinated in areal bond which joins in the restoration of the foam material.

An embodiment of this type is known from the German patent disclosure No. 31 33 271. There, the expandable foil lies on the broadside of a coiled compressed foam material strip. For a defined detachment, the areally bonded foil can be torn along a helical line which is oriented on the coiling joint of the sealing strip. Concerned here may be a perforation. A sealing strip of this type is unsuited for large joints. Such large joints are provided, e.g., in parking floors of appropriate large-scale buildings. The temperature-dependent width change of these joints may amount up to 40%. Involved are primarily sealing problems between the front edge of the foil and the joint wall. An additional problem is that of damage to the foil due to its exposed position, which is still more pronounced through its distinct convex crowning. These reasons also contribute to the fact that the desirable permanent seal is not established. The delayed restoring effect is based on an impregnating method, for instance with chloric paraffin which lines the open-cell foam skeleton, i.e., the pore walls. The compressed foam material sealing strip gradually restores to original condition. A codeterminant in this restoring is the temperature factor. At any rate, however, a retardation of a magnitude such is accomplished that sufficient time will be available for laying. Depending on finish, this time is in the range of even several hours. The respective manufacturing method is described in the German patent document No. 15 69 052.

The problem underlying the invention is to improve the sealing situation and provide for a favorable manufacture and use in wide joints, by way of the solutional idea that the final expanded position of the foil is reached with balanced restoring force loads.

SUMMARY OF THE PRESENT INVENTION

This inventional problem is solved in that the foil is fashioned as an intermediate layer areally bonded to two foam material layers, between these layers.

Owing to such design, a sealing strip of high utility is obtained: A surprisingly tight fit of the fronts on the joint wall is attained. This results from the favorable inside position of the foil; concurrent restoring forces of the two foam material layers act on both sides of this plane. The explained exposed position is avoided by simple means through the present incorporation. The protected arrangement guarantees a sealing function over long periods of use. Extending on both sides are practically protective cushions in front of this basically sensitive moisture barrier. Also, the position of insertion is accomplished more effectively, due to restoring "force stores" located on both sides. Positional truth between foil and the foam material layers embedding it in sandwich fashion can be promoted by simple means through T-shaped foil front ends which with their T-shanks overlap the foam material edges on the joint wall side. The sealing contact of the front ends is thus maintained; the front ends will not retract. Another favorable possibility is fashioning the foil as a sleeve enveloping the foam material layer. If it is desired to lose practically no restoring forces at all for the expansion of the foil, the invention suggests in the case of a sealing strip consisting of open-cell, precompressed foam material and serving specifically the sealing of joints, with delayed restoring, with which strip a foil is coordinated in areal bond which joins in the restoring of the foam material, that the foil be fashioned in restoring direction as a corrugated intermediate layer between the two foam material layers, with the overall stretch length of the foil which points in restoring direction corresponding to the extent of the maximally restored sealing strip. The corrugation or curling, respectively, forms here the stretching supply. Otherwise, the same described advantages occur in view of the balanced position of insertion of the sealing strip as well as the high tightness in the area of the edges adjacent to the joint walls, except that now the full force of the foam material "force store" becomes effective. Additionally, the invention suggests that the intermediate foil be adhesively joined with the two foam material layers. The respective containment proves to be more stable than the inherent adhesive effect which is to be utilized from the impregnation retarding the restoration. Additionally it is advantageous for the corrugated shape of the intermediate foil to result from the precompression of the foam material. Such a measure offers especially manufacturing advantages over a precorrugation of the foil; there is no specific device required which produces the corrugation. Obtained is an intimate connection between foil and sideways foam material layers. The corrugation assuming or being able to assume, respectively, also relief structures, a joining type known in woodworking as dovetailing is on hand in the form of an intimate interlinking. The areal bond is preferably accomplished by using a permanently elastic adhesive, with the intermediate foil being coated with adhesive on both sides. Moreover, a design such is suggested that the foil is a skin which is uniformly covered with the foam material. This skin is obtained by closing the pores with the aid of a hot doctor blade. Lastly, the invention suggests in the case of a joint sealed with a sealing strip that the foil edges next to the joint wall be glued to the joint wall. Coated with epoxy resin, e.g., the joint walls produce in this area a favorable interlinking bond, depending on adhesive or adhesive curing time, respectively, with the adhesive penetrating into the open pores and producing here a favorable depth anchoring and a seal. Slightly protruding relative to the soft foam material skeleton, the front ends or front edges of the foil enter the adhesive so that here a maximum sealing effect is accomplished even in the case of rough joint walls.

The object of the application will be more fully explained hereafter with the aid of the drawing.

DESCRIPTION OF A PREFERRED EMBODIMENT

The sealing strip D consists of at least two superposed foam material layers 1. These layers comprise an open-cell precompressed foam material whose individual cells 2 are connected with one another so that a spongy skeleton 3 is obtained.

The foam material is impregnated. Suitable for that purpose, e.g., is chloric paraffin. It lines the cell walls 2'. These lined cell walls 2' stick to one another in compressed condition. But this adhesive force is overcome by the restoring force of the foam material. A gradual restoring to the original structure thus takes place.

Located between the foam material layers 1 is a thin foil 4. The foil is fashioned as an intermediate layer between these layers and is bonded to the foam material layers 1 located on both sides.

Figure 2:
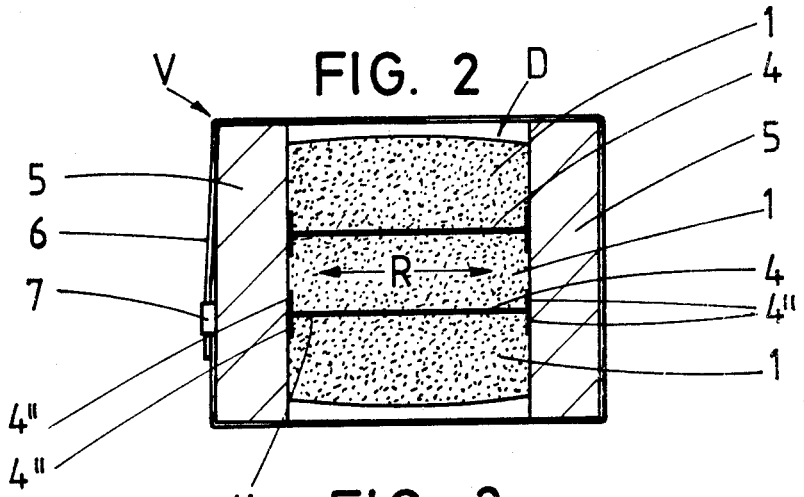
FIG. 2 is a cross-sectional view of a sealing strip in a condition ready for use, that is, compressed, and, in a packing retaining this condition, with a stretchable intermediate foil.

In the case of the embodiment of the sealing strip D shown in FIG. 2, the intermediate foil 4 consists of stretchable foil material which joins in the restoring. Its relieved original areal size corresponds to the areal size of the compressed foam material layers 1. The foil 4 extends in the restoring direction R of the layers compressed inward from the narrow sides 1'. The narrow sides (that is, the thickness) of the foam material layers 1 have a height x which corresponds approximately to one-seventh of the dimension y of the strip width in restored condition.

Made from three foam material layers 1, the sealing strip D of the presented embodiment is being held between slats 5 which are coated in such a way that the compressed sealing strip can be removed from the jaw type slats once the banding 6 securing the packing V has been removed. Suitable slats are boards. The clamps securing the banding 6 are marked 7.

The foil 4 consisting of stretchable material can be introduced in a continuous operation. It is placed as a strip between the foam material layers 1 precompressed, e.g., by rollers. Here, too, the retarded restoring represents a favorable prerequisite for this type of finishing. The metered sealing strip sections advance then to the packing operation. A so-called stick packing has been described in the German utility Pat. No. 83 30 528 of the filant.

Remaining in compressed condition of some time, the sealing strip D is upon removal of the slats 5 inserted in a joint F for sealing purposes. The open-pore narrow sides 1' of the sealing strip D and the narrow ends 4' of the foil 4 facing toward the joint wall bear down in sealing fashion on the joint wall 8. According to FIG. 2 (first embodiment) the front ends are designed T-shaped in such a way that equally long T-shanks overlap in anchoring fashion the edges of the foam material layer narrow sides 1' next to the joint wall, thus preventing the stretchable foil 4 from pulling inward. The T-shanks are marked 4''. Viewed in cross section, the foil features a double-T profile with the T-web forming the stretch zone. Another possibility of securing against foil slippage is fashioning the foil 4 as a sleeve which envelops the foam material 1. This variant is not shown in the drawing.

Figure 3:
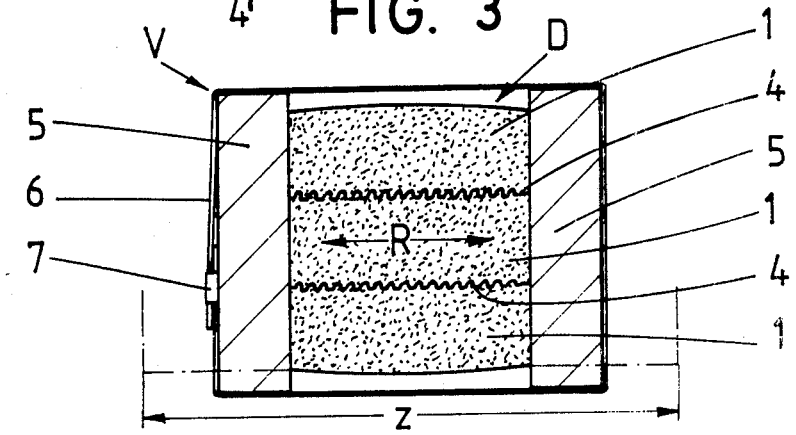
FIG. 3 is a cross-sectional view of the sealing strip in a condition ready for use, that is, compressed, and, in a packing retaining this condition, with an intermediate foil stretchable in the restoring direction.

The variant relative to FIG. 3 differs from the previously described design in that the foil 4 is fashioned as an intermediate layer between two foam material layers 1 that extends in corrugated fashion in restoring direction, double arrow R. The respective corrugation forms the length supply which joins in the restoring, with the overall stretch length of the foil 4 which points in restoring direction corresponding to the dimension z of the maximally restored sealing strip D (FIG. 3). Here, no forces at all are lost with regard to the restoring of the foam material. With same basic dimensions of the sealing strip D a still wider joint F can thus be sealed.

Figure 4:
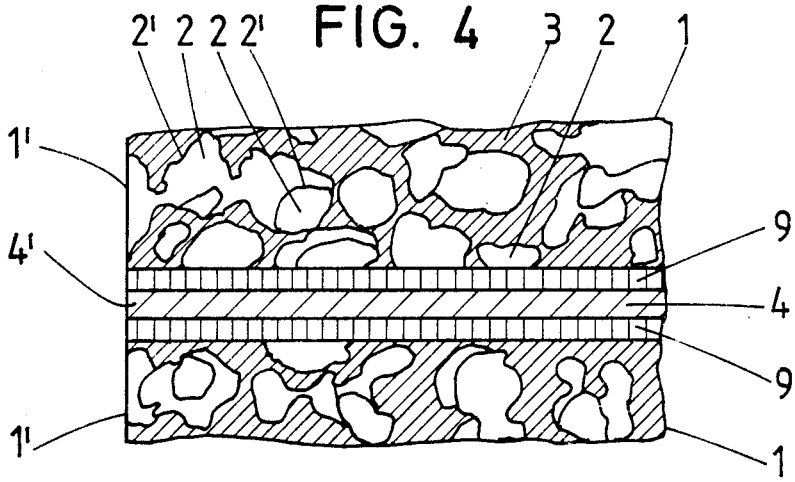
FIG. 4 is an enlarged sectional view of the foil with an adhesive coating on both sides and with the adjacent skeleton of the foam material layers.

The intermediate foil 4 is areally bonded to both foam material layers 1. To this end, a self-adhesive layer 9 is provided on both sides which establishes a bond both with the foil 4 and the porous skeleton 3 of the foam material layers 1 bearing on it. The respective design can be seen from the enlargement relative to FIG. 4. The permanently elastic self-adhesive layer 9 forces itself additionally into the cut cells 2, although this is not illustrated, so as to anchor itself. This occurs especially effectively on the undercut pore wall sections.

Figure 1:
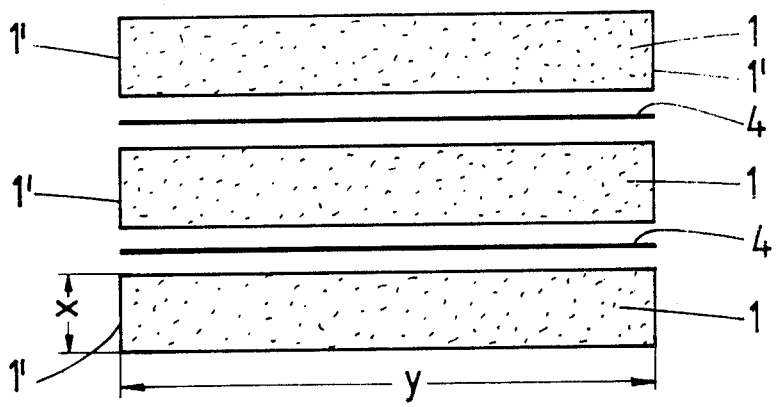
FIG. 1 is a cross-sectional view of a sealing strip, in a condition in which the layers are not bonded to the foil.
Figure 5:
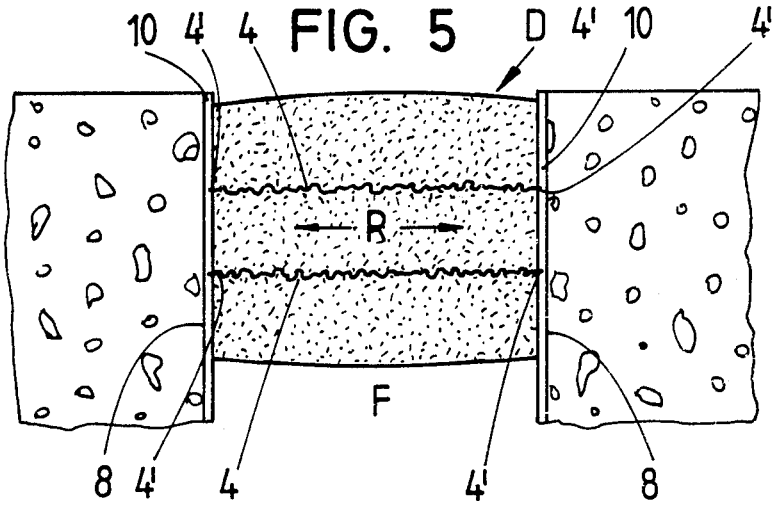
FIG. 5 is a cross-sectional view of the sealing strip inserted in a joint.
Figure 6:
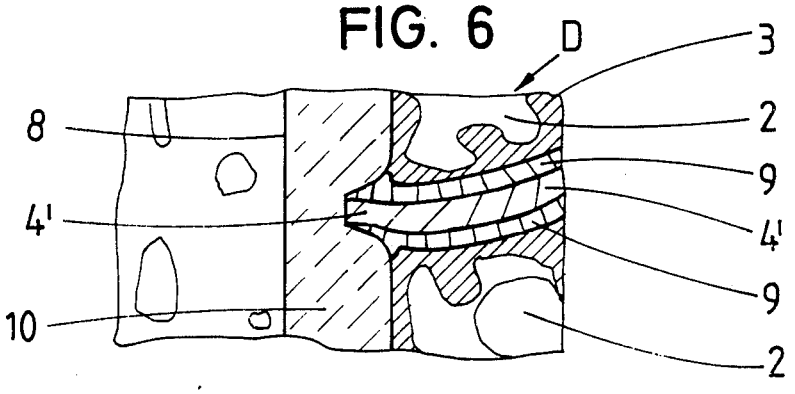
FIG. 6 is an enlarged cross-sectional view of the area of the edge next to the joint wall.

The corrugated shape of the intermediate foil 4 results from precompressing the foam material. Areally equally large, the materials are joined in an arrangement depicted in FIG. 1, are forced together with their wide areas and then fed to a device which effects the compression, here also, from the narrow sides 1' inward until the materials have the cross section that corresponds to the packing according to FIG. 3. The corrugation occurring as a result of the precompression can be seen from FIGS. 3 and 5. Concerned is a prolific curling which in addition to the restoring force of the two foam material layers located on both sides stores itself a certain restoring force so that the narrow ends 4', acting here as lip type front edges, with the sealing strip D inserted according to FIG. 5, permanently possess additionally a certain tendency to an exposed forward position producing a very tight contact with the joint walls 8 that favors impermeability to water. This front edge contact of the protruding narrow edges 4' can still be optimized in that the joint walls 8 feature an adhesive layer 10 from epoxy resin. Created here is the dovetailing zone which in bold strokes can be termed an S-joint and can be seen from FIG. 6. The self-adhesive layers 9 bonding the end areas of the foil 4 to the adjoining foam material layers 1 migrate also into the adhesive layer 10 and establish a bond with it.

The sliced cells 2 facing toward the joint wall 8 produce as well a favorable depth anchoring through partial penetration of the adhesive layer 10 in these cells. Occurring in the process is a balanced hold-down position of insertion due to the embedding 4 between two essentially equally large foam material layers. By multiple layer design it is possible to realize additional moisture barriers successively in the fashion presented in FIG. 5. Three-layered here, the lamination of the sealing strip D produces there a second moisture barrier.

The foil 4 may also be a integral part of the foam material layer 1 in that the latter is skinned, for instance over its wide area. The skin is formed by closing the pore surface in that area under a light melting of the foam material skeleton 3 by means of a blade or similar. In addition to a thermal treatment, skinning can also be accomplished chemically. Even the spray application of a skin resulting in water-tight conditions can be realized. The sealing strip D is then constructed as explained above.

The corrugation can also be designed as a precorrugation of the foil 4.

From the above disclosure of the general principles of the present invention and the above description of a preferred embodiment, those skilled in the art will readily comprehend various modifications to which the invention is susceptible. Therefore, I desire to be limited only by the scope of the following claims.

I claim:

1. A joint between two spaced walls, said joint comprising a sealing strip disposed between said walls, said sealing strip being formed of open-cell, compressed foam material with retarded restoring capability, said sealing strip comprising two layers of said foam material, an intermediate layer of stretchable foil, said intermediate layer having corrugations extending transversely to the restoring direction of said foam layers, said foil being bonded to at least one of said foam layers, the length of said corrugated foil when expanded in the restoring direction of said foam layers corresponding to the outer dimension of said maximally restored sealing strip, the ends of said foil engaging said joint walls and being adhesively secured thereto.

2. A sealing strip of open-cell compressed foam material with retarded restoring capability for use in sealing joints, said sealing strip comprising two layers of said foam material, an intermediate layer of stretchable foil, said intermediate layer having corrugations extending transversely to the restoring direction of said foam layers, said foil being bonded to at least one of said foam layers, the length of said corrugated foil when expanded in the restoring direction of said foam layers corresponding to the outer dimension of said maximally restored sealing strip.

3. The sealing strip of claim 2 in which the ends of said foil are T-shaped and include shanks which overlap the edges of said layers of foam material on the sides of said strip adapted to abut the joint walls.

4. The sealing strip of claim 2 in which said foil forms a sleeve enveloping a layer of foam material.

5. The sealing strip of claim 2 in which said intermediate foil is adhesively bonded to both layers of foam material.

6. The sealing strip of claim 2 in which the corrugated shape of the intermediate foil is formed by pre-compressing said foam material.

7. The sealing strip of claim 5 in which both sides of said intermediate foil are coated with a self-adhesive layer.

8. The sealing strip of claim 2 in which said foil comprises a skin which is integrally formed on said foam material.

* * * * *